US008028358B2

(12) United States Patent
Fiore, Jr.

(10) Patent No.: US 8,028,358 B2
(45) Date of Patent: Oct. 4, 2011

(54) SYSTEM AND METHOD FOR STORING AN ACCESSORY PART IN A PLAY YARD

(75) Inventor: Joseph F. Fiore, Jr., Lebanon, PA (US)

(73) Assignee: Wonderland Nursery Goods Company Limited (TW)

( * ) Notice: Subject to any disclaimer, the term of this patent is extended or adjusted under 35 U.S.C. 154(b) by 0 days.

(21) Appl. No.: 12/555,084

(22) Filed: Sep. 8, 2009

(65) Prior Publication Data

US 2010/0058535 A1 Mar. 11, 2010

Related U.S. Application Data

(60) Provisional application No. 61/191,761, filed on Sep. 11, 2008.

(51) Int. Cl.

| | |
|---|---|
| ***A47D 7/00*** | (2006.01) |
| ***A47D 13/06*** | (2006.01) |
| ***A47D 15/00*** | (2006.01) |
| ***A47C 21/00*** | (2006.01) |

(52) U.S. Cl. ..... 5/93.2; 5/93.1; 5/658; 5/503.1

(58) Field of Classification Search ..... 5/93.2, 5/93.1, 97, 98.1, 98.3, 99.1, 655, 658, 503.1
See application file for complete search history.

(56) References Cited

U.S. PATENT DOCUMENTS

| | | | | |
|---|---|---|---|---|
| 4,073,017 | A * | 2/1978 | Stevens | 5/97 |
| 5,163,191 | A * | 11/1992 | Chan | 5/98.1 |
| 5,339,470 | A * | 8/1994 | Shamie | 5/98.1 |
| 5,778,465 | A * | 7/1998 | Myers | 5/99.1 |
| 5,813,064 | A * | 9/1998 | Hartenstine | 5/99.1 |
| 5,862,548 | A | 1/1999 | Gerhart | |
| 6,058,528 | A * | 5/2000 | Yang | 5/93.1 |

(Continued)

FOREIGN PATENT DOCUMENTS

DE 19781862 T1 7/1999

(Continued)

OTHER PUBLICATIONS

Littleshield Nursery Products web page for a "lightweight travel cot / travel centre". http://web.archive.org/web/20080731090952/littleshield.com/travelcentre.htm: printed Dec. 22, 2009.

(Continued)

*Primary Examiner* — Robert G Santos
(74) *Attorney, Agent, or Firm* — Baker & McKenzie LLP; David I. Roche

(57) ABSTRACT

A system for facilitating the storage of an accessory part such as a changer station, bassinet or canopy includes a play yard, and an accessory kit that can be detachably or permanently secured on the play yard. The play yard comprises a frame structure having a plurality of side rail assemblies. The accessory kit comprises a foldable accessory part and a storage pocket that can be secured with one upper rim of the play yard. The accessory part can be folded into a compact form that fits in the storage pocket. When the user wishes to use the accessory part, the user can pull out and unfold the accessory part, and then fasten the accessory part on opposite sides of the play yard for adequate support. The ability to stow the accessory part in a compact manner in the play yard facilitates portability of the accessory part and play yard.

21 Claims, 5 Drawing Sheets

U.S. PATENT DOCUMENTS

| | | | | |
|---|---|---|---|---|
| 6,131,218 | A * | 10/2000 | Wang | 5/93.1 |
| 6,182,308 | B1 * | 2/2001 | Yang | 5/93.1 |
| 6,430,762 | B1 | 8/2002 | Cheng | |
| 6,493,891 | B1 * | 12/2002 | Livingston | 5/636 |
| 6,526,608 | B1 | 3/2003 | Hsia | |
| 6,539,563 | B1 | 4/2003 | Hsia | |
| 6,588,033 | B1 * | 7/2003 | Welsh et al. | 5/99.1 |
| 6,634,038 | B2 * | 10/2003 | Hsia | 5/95 |
| 6,687,927 | B1 * | 2/2004 | Tharalson et al. | 5/98.1 |
| 6,895,611 | B2 * | 5/2005 | Tharalson et al. | 5/99.1 |
| 6,907,626 | B1 * | 6/2005 | Welsh et al. | 5/99.1 |
| 6,952,849 | B2 * | 10/2005 | Pacella | 5/658 |
| 7,055,191 | B1 * | 6/2006 | Chen | 5/93.2 |
| 7,225,483 | B1 * | 6/2007 | Remblad | 5/417 |
| 7,409,733 | B2 * | 8/2008 | Tharalson et al. | 5/98.1 |
| 2004/0187212 | A1 * | 9/2004 | Pacella | 5/503.1 |
| 2006/0218725 | A1 | 10/2006 | Carpenter et al. | |
| 2008/0209631 | A1 | 9/2008 | Thomas et al. | |
| 2010/0058535 | A1 * | 3/2010 | Fiore, Jr. | 5/93.1 |

FOREIGN PATENT DOCUMENTS

| | | | |
|---|---|---|---|
| GB | 2375299 | A | 11/2002 |

OTHER PUBLICATIONS

Office Action dated Oct. 21, 2010 in DE 102009040777.4-16.

* cited by examiner

SYSTEM AND METHOD FOR STORING AN ACCESSORY PART IN A PLAY YARD

RELATED APPLICATION

This application claims priority of provisional application No. 61/191,761, filed on Sep. 11, 2008.

FIELD OF THE INVENTION

The present invention generally relates to nursery devices for supporting a baby or young child occupant, and more particularly to a system and method for storing an accessory part in a play yard.

DESCRIPTION OF THE RELATED ART

As caregivers and children have more active lifestyles, child care products are being used in an ever increasing number of activities and environments. In particular, portable play yards are used in a variety of activities and are both able to fold, providing portability for the traveling child and caregiver in various environments. While the portable play yard can fold down into a small portable package, accessory parts such as removable diaper changing stations, removable bassinets and removable canopies usually have rigid structures that cannot be collapsed or disposed in a convenient manner. As a result, these accessory parts generally have to be carried separately, which hinders the portability of the products. Additionally, storing and unintentionally leaving a removable accessory part on the play yard may also hinder the convenience of the portable play yard.

Therefore, there is presently a need for a system and method that can store accessory parts such as changing stations, canopies and bassinets in the play yard in a convenient manner, and address at least the foregoing issues.

SUMMARY

The present application describes a system and method for storing an accessory part in a play yard. According to one embodiment, the accessory part may be incorporated in an accessory kit that can fitly secure on the play yard. The accessory kit comprises a storage pocket and an accessory part. The accessory part is foldable into a compact form that can fit in the storage pocket, and is unfolded out of the storage pocket and attached with the play yard in a use configuration.

According to another embodiment, a play yard is described. The play yard comprises a frame structure, a storage pocket provided at one side of the frame structure, and an accessory part used in combination with the play yard. The accessory part is foldable into a compact form that fits in the storage pocket. In a use configuration, the accessory part is unfolded out of the storage pocket and attached with the play yard.

According to yet another embodiment, a method of using the accessory kit is described. The method comprises pulling the accessory part out of a storage pocket provided at one side of the frame structure, unfolding the accessory part, and fastening the accessory part with the play yard.

At least one advantage of the systems and methods described herein is the ability to provide an accessory kit that can fit within the envelope of the play yard. In a use configuration, the accessory part of the kit can be unfolded from the storage pocket and attached with the play yard. In a storage configuration, the accessory part can conveniently fold and stow in the storage pocket. Portability of the accessory part and play yard can therefore be facilitated.

The foregoing is a summary and shall not be construed to limit the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENTS

The present application describes a system and method for storing an accessory part in a play yard. The system includes a play yard, and an accessory kit that can be detachably or permanently secured on the play yard. The play yard comprises a frame structure having a plurality of side rail assemblies. The accessory kit comprises an accessory part and a storage pocket that can be secured with one of the side rail assemblies. The accessory part is made of a flexible material that can be folded into a compact form that fits in the storage pocket. When the user wishes to use the accessory part, the user can pull out and unfold the accessory part, and then fasten the accessory part on the side rail assemblies for adequate support. The ability to stow the accessory part in a compact manner in the play yard facilitates portability of the accessory part and play yard. Examples of the accessory part can include, without limitation, a changer station, bassinet, canopy, and the like. The accessory parts may be used in combination with either collapsible or non-collapsible play yards.

For the sake of clarity, the term "play yard" employed herein can refer to any play yard, crib, cradle, bed, free standing bassinet, playpen or like structures having a space enclosed between walls for accommodating children, babies, pets or the like.

Figure 1A:
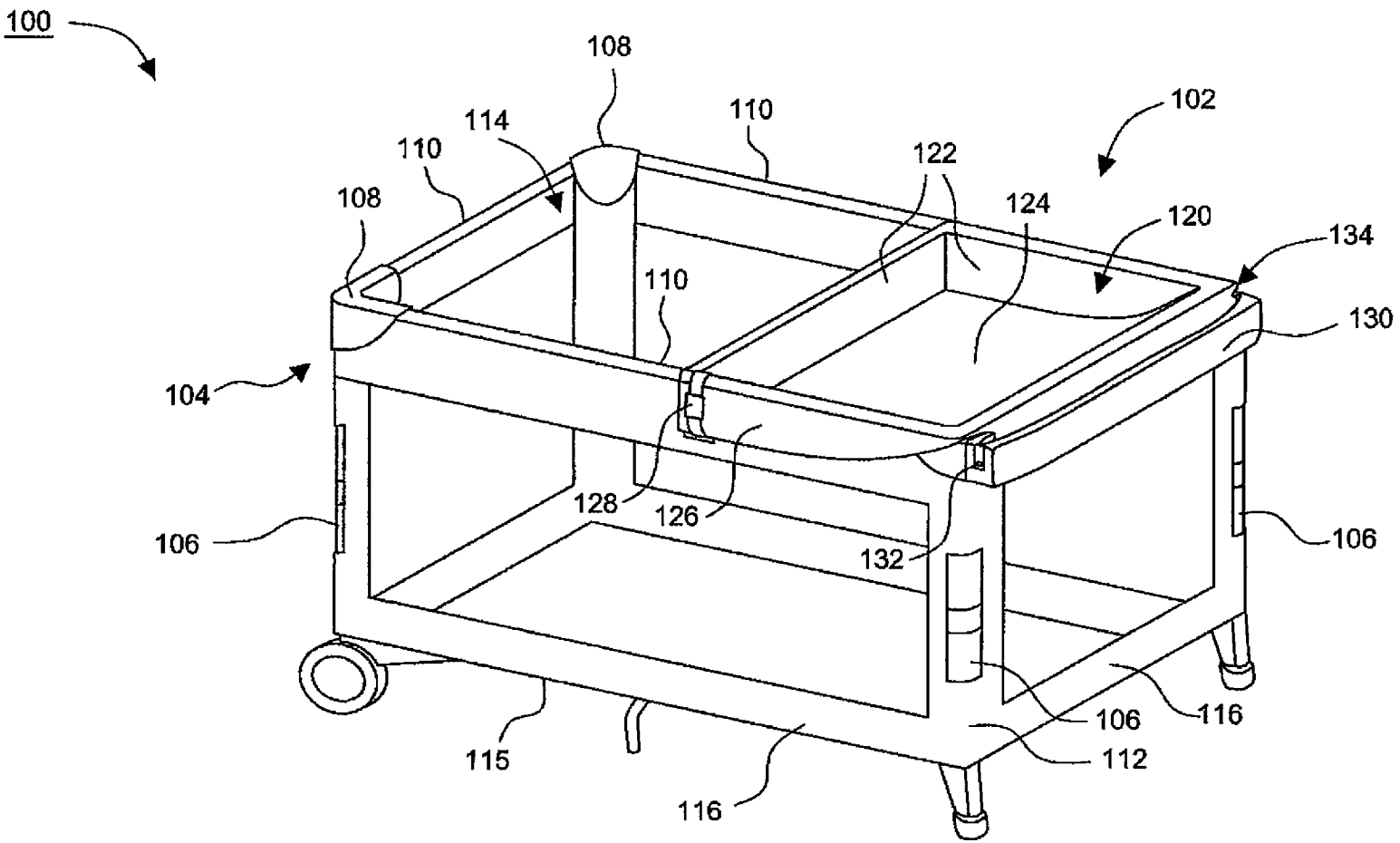
FIG. 1A is a schematic view illustrating one embodiment of a play yard provided with a foldable changer station.

FIG. 1A is a schematic view illustrating one embodiment of a play yard 100 provided with an accessory kit that incorporates a foldable changer station 102. The play yard 100 may comprise a frame 104 that includes a plurality of upright support legs 106. In one embodiment, the support legs 106 may be formed by rigid tubular segments, each of which can be deployed for use and collapsed for facilitating storage of the frame 104. An upper end of the frame 104 includes corner brackets 108, each of which joins contiguous side rail assemblies 110 that altogether define an upper rim of the frame 104. A fabric material 112 is secured and stretched adjacent to the support legs 106 to define sidewalls 116 of a rectangular enclosure having an inner volume 114 for placement of a baby or young child. A bottom 115 of the inner volume 114 may include a cushion, mattress or like structure for providing comfortable support to the occupant placed therein.

Moreover, one or more of the sidewalls 116 may include a transparent or semi-transparent cloth material such that the inner volume 114 can be visible from the outside through the sidewall 116.

The changer station 102 is an accessory element that can facilitate the change of diapers or cloths of a child placed therein. The structure of the changer station 102 preferably includes materials that allow folding of the changer station 102 into a compact form. In one embodiment, the materials used for making the changer station 102 may include fabrics, or like flexible materials sufficiently resistant to sustain at least the weight of an infant placed in the changer station 102. To facilitate its shaping and support, the changer station 102 may also include stiffening elements (such as rigid boards or rods) assembled with the flexible material. In a use configuration, the unfolded changer station 102 spans across a gap between the side rail assemblies 110 for forming a rectangular enclosure that has an inner volume 120 partially delimited by sidewalls 122 and a bottom 124. In addition, the unfolded changer station 102 may include a plurality of flap portions 126 that wrap around several of the side rail assemblies 110, and are and attached adjacent to the side rail assemblies 110 via fastener devices 128 for locking the changer station 102 in position. The changer station 102 thereby formed is at least partially contained inside the inner volume 114 of the play yard 100, hung above the bottom 115 by at least some of the side rail assemblies 110.

Figure 1B:
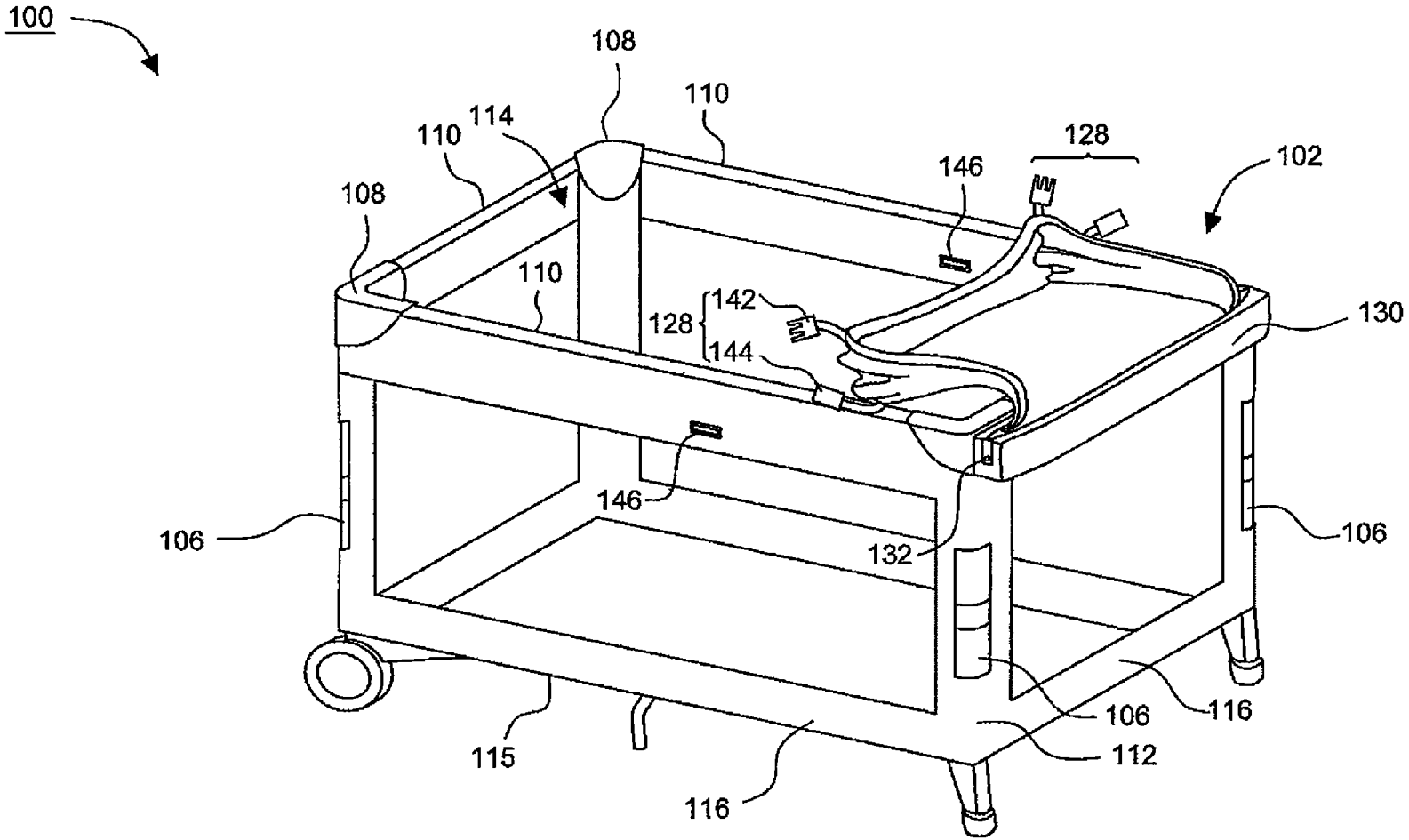
FIG. 1B is a schematic view illustrating the changer station of FIG. 1A in a folded configuration.

As shown in FIG. 1B, when the changer station 102 is not used, the fastener devices 128 may be unlocked, and the changer station 102 may then be folded and accommodated in a storage pocket 130 provided at one side of the play yard 100. In one embodiment, the storage pocket 130 may be made of a flexible material that forms an elongated envelope, provided with a zipper or slide fastener 132 for its sealing. The storage pocket 130 may be secured along one of the side rail assemblies 110, either in a permanent or detachable manner. When the folded changer station 102 is accommodated in the storage pocket 130, the profile of the storage pocket 130 can smoothly fit within the structural envelope of the play yard 100. In case the play yard 100 has a collapsible structure, the play yard 100 may be turned to a collapsed state while the changer station 102 is conveniently stowed in the storage pocket 130. As a result, portability of the accessory part along with the play yard can be facilitated.

It is worth noting that the changer station 102 may be permanently affixed with the storage pocket 130 (FIG. 1A) in some embodiment. In this case, an end 134 of the changer station 102 may be joined with an inner side of the storage pocket 130 by methods such as sewing, ultrasonic welding, or the like. Permanent joining of the changer station 102 with the storage pocket 130 can prevent separate loss of the changer station 102 or storage pocket 130.

Figure 1C:
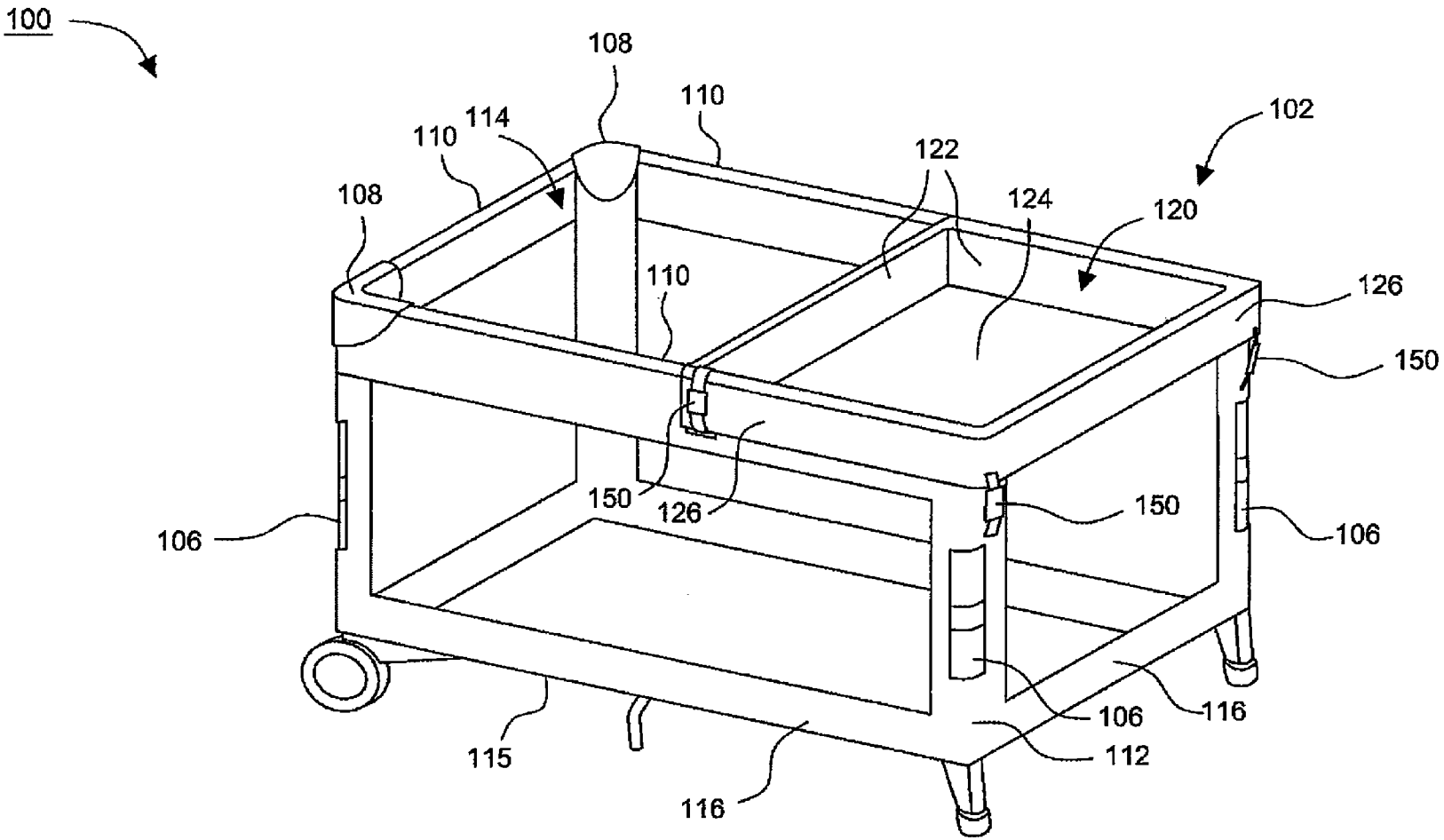
FIG. 1C is a schematic view illustrating another variation of the embodiment shown in FIG. 1A.

In alternate embodiments, the changer station 102 may also be provided independent of and entirely removable from the storage pocket 130, as illustrated in FIG. 1C. A changer station 102 that is independent of the storage pocket 130 may facilitate repair, cleaning, or replacement operations.

For appropriately securing the changer station 102 with the play yard 100, any attachment systems may be suitable for the fastener devices 128. As better shown in FIG. 1B, an embodiment of one fastener device 128 may include a buckle system having spaced-apart male buckle 142 and female buckle 144 respectively affixed at one distal end of the changer station 102. After the changer station 102 is unfolded, one of the male or female buckle, e.g., female buckle 144, may pass through an opening 146 provided through one side rail assembly 110, loops around the side rail assembly 110 and then fastens with the male buckle 142 for locking the changer station 102 in place. As shown in FIG. 1C, another embodiment of the fastener device may include a hook-and-loop or Velcro™ fastener system 150, which may be suitable for fastening the changer station 102. It will be readily appreciated that any combination of the hook-and-loop fastener system, buckle system, and the like may also be possible for securing the changer station 102 with the frame 104.

While the foregoing embodiments have been described in conjunction with a changer station as one example of application, other types of accessory parts used in combination with a play yard may also be provided in the form of accessory kits by applying similar design principles.

Figure 2:
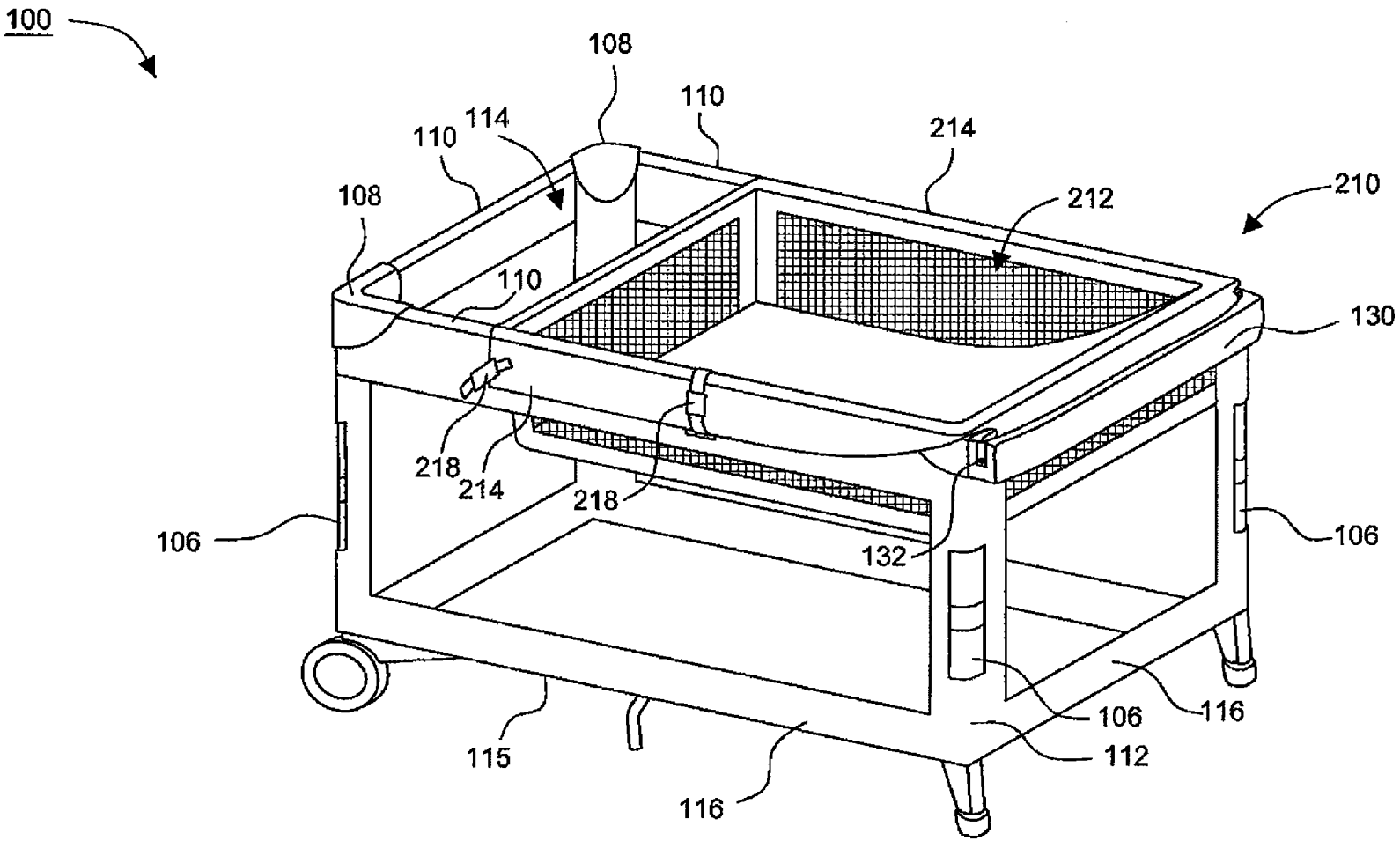
FIG. 2 is a schematic view illustrating one embodiment of a play yard provided with a foldable bassinet.

FIG. 2 is a schematic view of the play yard 100 provided with another accessory kit incorporating a foldable bassinet 210. The bassinet 210 can be used for accommodating a child in a laid-down position, such as when the child is sleeping. The bassinet 210 may enclose an inner volume 212 that is larger and deeper than the inner volume of the changer station 102 (FIG. 1A) to ensure optimal comfort for the occupant placed therein. The design of the bassinet 210 may be similar to that of the changer station 102 described previously, including flap portions 214 that wrap around the side rail assemblies 110 and attached via fastener devices 218. When it is not used, the bassinet 210 may be folded and stowed in the storage pocket 130. When a user wants to use the bassinet 210, the user can pull the bassinet 210 out of the storage pocket 130, unfold the bassinet 210, and then securely attach it with the play yard 100 via the fastener devices 218. The bassinet 210 is thereby hung from the side rail assemblies 110 above the bottom 115 of the play yard 100, and is adapted for receiving the placement of an infant therein.

Figure 3:
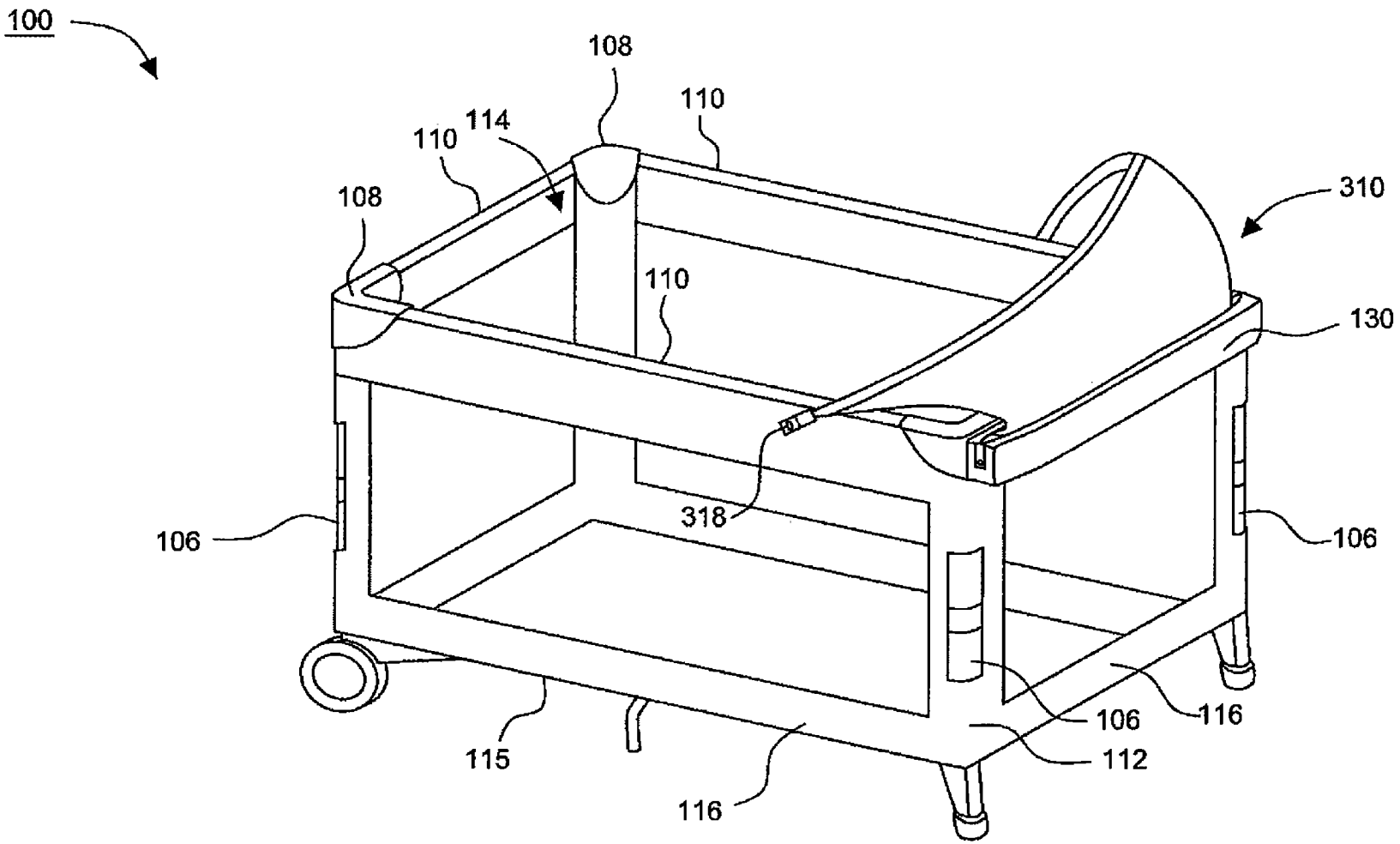
FIG. 3 is a schematic view illustrating one embodiment of a play yard provided with a foldable canopy.

FIG. 3 is a schematic view illustrating the play yard 100 provided with another exemplary accessory kit incorporating a foldable canopy 310. The canopy 310 can be used as an overhanging covering that projects above the side rail assemblies 110 at one side of the play yard 100. Like the embodiments previously described, the canopy 310 may be made of a flexible material (such as fabrics) for facilitating its folding and storage in the storage pocket 130. When it is not used, the canopy 310 may be folded and stowed in the storage pocket 130. When a user wants to use the canopy 310, the user can pull the canopy 310 out of the storage pocket 130, unfold the canopy 310, and then securely attach it with the play yard 100 via fastener devices 318.

As described above, advantages of the systems and methods described herein include at least the ability to provide an accessory kit that can fit within the envelope of the play yard. In a use configuration, the accessory part of the kit can be unfolded from the storage pocket and attached with the play yard. In a storage configuration, the accessory part can conveniently fold and stow in the storage pocket. Portability of the accessory part and play yard can therefore be facilitated.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A play yard comprising:

a frame structure;

a storage pocket provided at one side of the frame structure; and an accessory part used in combination with the play yard, wherein an end of the accessory part is permanently joined with the storage pocket, the accessory part is foldable into a compact form that fits in the storage pocket, and the accessory part is unfolded and attached with the frame structure in a use configuration.

2. The play yard according to claim 1, wherein the accessory part comprises a changer station, a bassinet or a canopy.

3. The play yard according to claim 1, wherein the accessory part when unfolded spans across a gap area between a plurality of side rail assemblies that delimit at least partially an upper rim of the frame structure.

4. The play yard according to claim 3, wherein the unfolded accessory part includes a plurality of flap portions that are attached adjacent to at least two opposite side rail assemblies.

5. The play yard according to claim 1, wherein the accessory part includes a fabric material, or like flexible material.

6. The play yard according to claim 1, wherein the storage pocket is affixed along a portion of a side rail assembly that lies on an upper end of the frame structure.

7. The play yard according to claim 1, wherein the accessory part includes a plurality of fasteners for attaching the accessory part with the frame structure.

8. The play yard according to claim 7, wherein the fasteners include buckle fasteners, or hook-and-loop fasteners.

9. An accessory kit in combination with a play yard, wherein the play yard includes a frame structure, the accessory kit comprising:

a storage pocket; and an accessory part, wherein an end of the accessory part is permanently joined with the storage pocket, the accessory part is foldable into a compact form that fits in the storage pocket, and the accessory part is unfolded out of the storage pocket and attached with the frame structure in a use configuration.

10. The accessory kit according to claim 9, wherein the accessory part comprises a changer station, a bassinet or a canopy.

11. The accessory kit according to claim 9, wherein the accessory part when unfolded spans across a gap area between a plurality of side rail assemblies that define at least partially an upper rim of the frame structure.

12. The accessory kit according to claim 11, wherein the unfolded accessory part includes a plurality of flap portions that are attached adjacent to at least two opposite side rail assemblies.

13. The accessory kit according to claim 9, wherein the accessory part includes a fabric material, or like flexible material.

14. The accessory kit according to claim 9, wherein the storage pocket is affixed along a portion of a side rail assembly that lies on an upper end of the frame structure.

15. The accessory kit according to claim 9, wherein the storage pocket is adapted to be affixed on a first side of the play yard, and the accessory part has a side edge provided with a fastener that is located distant from the end joined with the storage pocket and is adapted to attach the accessory part with a second side of the play yard contiguous to the first side.

16. A method for mounting an accessory part on a play yard, wherein the play yard includes a frame structure, the method comprising:

pulling the accessory part out of a storage pocket secured at one side of the frame structure, wherein an end of the accessory part is permanently joined with the storage pocket;

unfolding the accessory part; and fastening the accessory part with the play yard.

17. The method according to claim 16, further comprising:

unfastening the accessory part from the play yard;

folding the accessory part; and placing the folded accessory part in the storage pocket.

18. The method according to claim 16, wherein the storage pocket is attached along a portion of a side rail assembly that lies on an upper end of the frame structure.

19. A play yard comprising:

a frame structure;

a storage pocket detachably provided at a first side of the frame structure; and an accessory part used in combination with the play yard, wherein the accessory part has an end portion permanently joined with the storage pocket, and a side edge portion provided with a fastener located distant from the end portion joined with the storage pocket, wherein the accessory part is foldable into a compact form that fits in the storage pocket, and the accessory part is unfolded and attached via the fastener with a second side of the frame structure contiguous to the first side in a use configuration.

20. The play yard according to claim 19, wherein the accessory part comprises a changer station, a bassinet or a canopy.

21. The play yard according to claim 19, wherein the storage pocket is affixed along a portion of a side rail assembly that lies on an upper end of the frame structure.

* * * * *